US010927794B2

(12) United States Patent
Choi

(10) Patent No.: US 10,927,794 B2
(45) Date of Patent: Feb. 23, 2021

(54) ACTIVE CANISTER PURGE SYSTEM AND DIAGNOSTIC METHOD THEREOF

(71) Applicants: HYUNDAI MOTOR COMPANY, Seoul (KR); KIA MOTORS CORPORATION, Seoul (KR)

(72) Inventor: Choo Saeng Choi, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 213 days.

(21) Appl. No.: 16/202,432

(22) Filed: Nov. 28, 2018

(65) Prior Publication Data

US 2019/0353119 A1 Nov. 21, 2019

(30) Foreign Application Priority Data

May 18, 2018 (KR) ..... 10-2018-0057012

(51) Int. Cl.
*F02M 25/08* (2006.01)

(52) U.S. Cl.
CPC .... *F02M 25/0809* (2013.01); *F02M 25/0854* (2013.01)

(58) Field of Classification Search
CPC ..... F02M 25/0809; F02M 25/0854
See application file for complete search history.

(56) References Cited

U.S. PATENT DOCUMENTS

| | | | | |
|---|---|---|---|---|
| 6,631,635 | B2 * | 10/2003 | Hanazaki | F02M 25/0809 73/114.38 |
| 8,312,765 | B2 * | 11/2012 | Pursifull | G01M 15/04 73/114.39 |
| 9,163,590 | B2 * | 10/2015 | Takeishi | F02M 25/0809 |
| 9,752,539 | B2 | 9/2017 | Burleigh et al. | |
| 9,932,937 | B2 * | 4/2018 | Jentz | F02M 25/0809 |
| 10,012,166 | B1 * | 7/2018 | Dudar | F01M 13/0011 |
| 10,138,827 | B2 * | 11/2018 | Dudar | F02D 41/004 |
| 10,196,992 | B2 * | 2/2019 | Imaizumi | F02M 25/0809 |
| 10,197,017 | B2 * | 2/2019 | Casetti | F02M 25/0809 |
| 10,495,030 | B1 * | 12/2019 | Dudar | F02M 25/0854 |
| 10,697,399 | B2 * | 6/2020 | Choi | F02M 25/0836 |
| 10,711,735 | B2 * | 7/2020 | Schwinn | F02M 25/0809 |
| 2006/0090553 | A1 * | 5/2006 | Nagasaki | F02M 25/0836 73/114.43 |

(Continued)

FOREIGN PATENT DOCUMENTS

| | | |
|---|---|---|
| JP | 2007-023925 A | 2/2007 |
| JP | 2017-521598 A | 8/2017 |

(Continued)

*Primary Examiner* — Freddie Kirkland, III
(74) *Attorney, Agent, or Firm* — Brinks Gilson & Lione

(57) ABSTRACT

An active canister purge system may include: a canister trapping a fuel vapor generated in a fuel tank; a purge control valve allowing the trapped fuel vapor to be purged from the canister into an intake pipe; a purge pump forcefully pumping the fuel vapor trapped in the canister into the intake pipe; a pressure sensor detecting a pressure at an inlet of the purge control valve; and a controller determining whether the pressure at the inlet of the purge control valve is varied on the basis of a pressure variation in the intake pipe in a non-purging condition to diagnose an open stuck state of the purge control valve.

13 Claims, 5 Drawing Sheets

(56) References Cited

U.S. PATENT DOCUMENTS

| | | | | |
|---|---|---|---|---|
| 2014/0130781 | A1* | 5/2014 | Jentz | F02M 25/0827 123/520 |
| 2016/0069304 | A1 | 3/2016 | Guidi | |
| 2017/0152813 | A1* | 6/2017 | Casetti | F02M 25/0809 |
| 2017/0152814 | A1 | 6/2017 | Casetti et al. | |
| 2018/0135565 | A1* | 5/2018 | Choi | F02D 41/0032 |
| 2018/0163659 | A1* | 6/2018 | Dudar | B60W 50/0205 |

FOREIGN PATENT DOCUMENTS

| | | |
|---|---|---|
| KR | 10-0736543 | 6/2007 |
| KR | 10-2007-0074970 | 7/2007 |

* cited by examiner

ACTIVE CANISTER PURGE SYSTEM AND DIAGNOSTIC METHOD THEREOF

CROSS-REFERENCE TO RELATED APPLICATION

This present disclosure claims priority to and the benefit of Korean Patent Application No. 10-2018-0057012, filed on May 18, 2018, the entire contents of which are incorporated herein by reference.

FIELD

The present disclosure relates to an active canister purge system and a diagnostic method thereof.

BACKGROUND

The statements in this section merely provide background information related to the present disclosure and may not constitute prior art.

Fuel stored in a fuel tank of a vehicle causes evaporative emissions (fuel vapors) over time. The fuel vapors may be released into the atmosphere, resulting in not only the waste of fuel but also air pollution due to the emission of unburned gases. Thus, the vehicle includes a canister purge system that supplies the fuel vapors generated in the fuel tank to an intake system of an engine.

The canister purge system includes a canister trapping the fuel vapors generated in the fuel tank, and a purge control valve to purge the trapped fuel vapors from the canister into the intake system of the engine. The purge control valve may be opened by a controller such as an engine control unit or an engine control module under a purge control condition that an engine negative pressure is sufficiently formed, and the fuel vapors trapped in the canister may be purged into the intake system of the engine.

Meanwhile, some engines, such as TGDI HEV, may have a relatively low negative pressure which is not sufficient to deliver the fuel vapors trapped in the canister to the intake system of the engine using only the negative pressure of the engine. As for a vehicle equipped with such an engine having a relatively low negative pressure, an active canister purge system having a purge pump forcefully purging the trapped fuel vapors from the canister into the intake system of the engine may be applied.

In the active canister purge system, the purge pump may be disposed between the purge control valve and the canister. As the purge pump is driven in a state in which the purge control valve is opened, the trapped fuel vapors may be forcefully purged from the canister into the intake system of the engine.

The conventional active canister purge system diagnoses a leakage of the fuel vapors by: opening the purge control valve when the engine is running and the negative pressure is formed; forming the negative pressure in the fuel tank in a state in which a canister close valve is closed; and detecting a pressure gradient (pressure variation) by a pressure sensor of the fuel tank.

We have discovered that the diagnosing leakage of the fuel vapors by the conventional active canister purge system is not accurate because the diagnosis relies on the pressure gradient, i.e., pressure variation in the fuel tank.

SUMMARY

The present disclosure addresses the above-mentioned problems occurring in the prior art while advantages achieved by the prior art are maintained intact.

An aspect of the present disclosure provides an active canister purge system and a diagnostic method thereof, providing an accurate diagnosis of a leak caused by an open stuck state of a purge control valve.

According to an aspect of the present disclosure, an active canister purge system may include: a canister trapping a fuel vapor generated in a fuel tank; a purge control valve configured to purge the trapped fuel vapor from the canister into an intake pipe; a purge pump forcefully pumping the fuel vapor trapped in the canister into the intake pipe; a pressure sensor detecting a pressure at an inlet of the purge control valve; and a controller determining an open stuck state of the purge control valve based on a change to the detected pressure at the inlet of the purge control valve while a pressure in the intake pipe in a non-purging condition varies.

The controller may diagnose that the purge control valve is in a full open stuck state when the pressure at the inlet of the purge control valve deviates beyond a predetermined pressure range.

The controller may diagnose that the purge control valve is in a middle open stuck state when the pressure at the inlet of the purge control valve is within a predetermined pressure range.

The controller may set different pressure ranges depending on whether a charger mounted on the intake pipe operates.

The controller may set a first pressure range when the charger does not operate, and the first pressure range may be defined by a first upper limit threshold and a first lower limit threshold.

The controller may diagnose that the purge control valve is in a full open stuck state when the pressure at the inlet of the purge control valve deviates beyond the first pressure range, and the controller may diagnose that the purge control valve is in a middle open stuck state when the pressure at the inlet of the purge control valve is within the first pressure range.

The controller may set a second pressure range when the charger operates, and the second pressure range may be defined by a second upper limit threshold and a second lower limit threshold.

The controller may diagnose that the purge control valve is in a full open stuck state when the pressure at the inlet of the purge control valve deviates beyond the second pressure range, and the controller may diagnose that the purge control valve is in a middle open stuck state when the pressure at the inlet of the purge control valve is within the second pressure range.

According to another aspect of the present disclosure, a diagnostic method of an active canister purge system may include: determining whether a non-purging condition is satisfied, the non-purging condition being a condition in which a purge pump does not operate and a purge control valve is closed; and determining, when the non-purging condition is determined, whether a pressure detected at an inlet of the purge control valve is varied in response to a pressure variation in an intake pipe.

The diagnostic method may further include diagnosing an open stuck state of the purge control valve when the pressure at the inlet of the purge control valve is varied in response to the pressure variation in the intake pipe.

The diagnosing of the open stuck state may include: diagnosing that the purge control valve is in a full open stuck state when the pressure at the inlet of the purge control valve deviates beyond a predetermined pressure range; and diagnosing that the purge control valve is in a middle open stuck state when the pressure at the inlet of the purge control valve is within the predetermined pressure range.

Different pressure ranges may be set depending on whether a charger mounted on the intake pipe operates.

A first pressure range may be set when the charger does not operate, and the first pressure range may be defined by a first upper limit threshold and a first lower limit threshold.

The diagnosing of the open stuck state may include: diagnosing that the purge control valve is in the full open stuck state when the pressure at the inlet of the purge control valve deviates beyond the first pressure range; and diagnosing that the purge control valve is in the middle open stuck state when the pressure at the inlet of the purge control valve is within the first pressure range.

A second pressure range may be set when the charger operates, and the second pressure range may be defined by a second upper limit threshold and a second lower limit threshold.

The diagnosing of the open stuck state may include: diagnosing that the purge control valve is in the full open stuck state when the pressure at the inlet of the purge control valve deviates beyond the second pressure range; and diagnosing that the purge control valve is in the middle open stuck state when the pressure at the inlet of the purge control valve is within the second pressure range.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
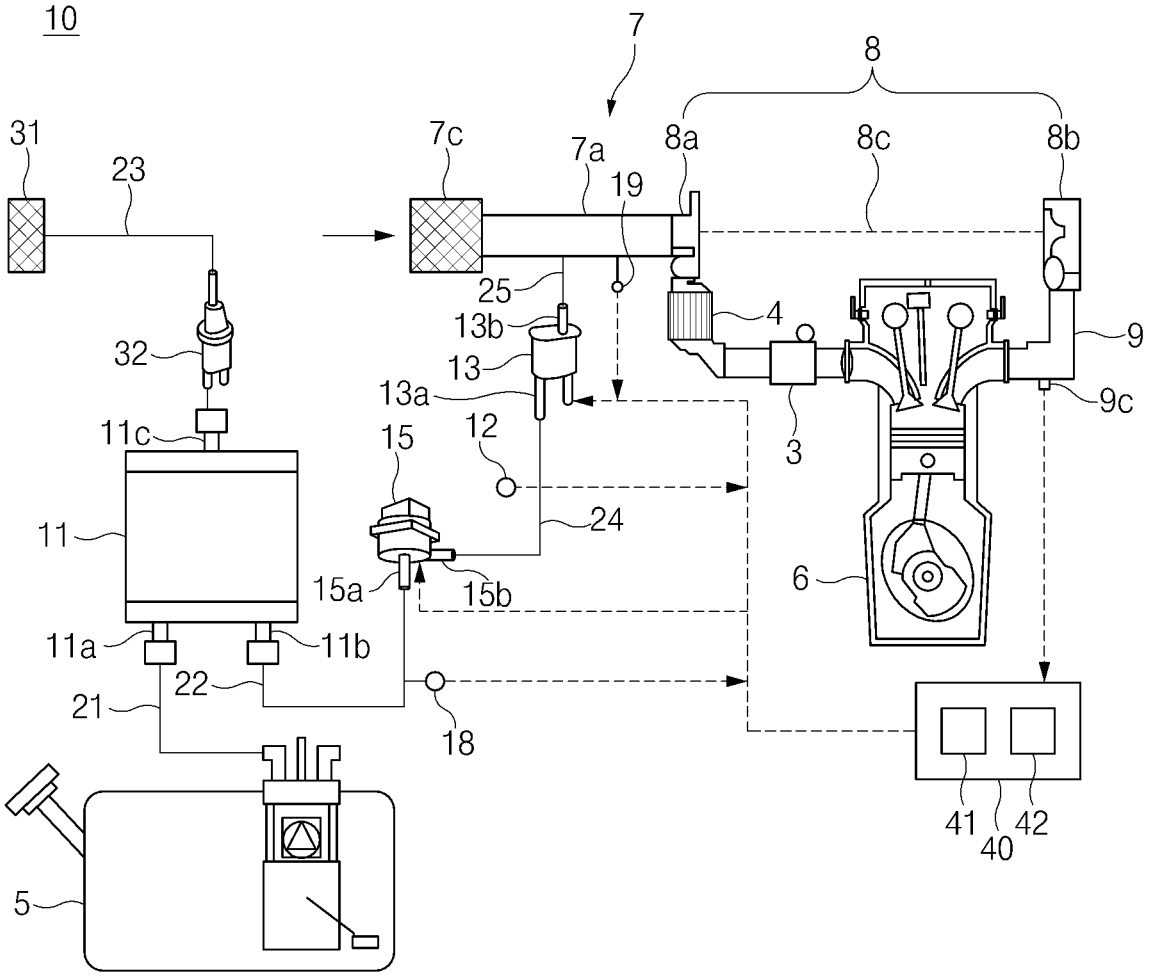
FIG. 1 illustrates the configuration of an active canister purge system according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, exemplary forms of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary forms of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present disclosure.

Referring to FIG. 1, an active canister purge system 10, according to an exemplary form of the present disclosure, may include a canister 11 trapping a fuel vapor generated in a fuel tank 5, a purge control valve 13 allowing the trapped fuel vapor to be purged from the canister 11 into an intake system 7 of an engine 6, and a purge pump 15 forcefully pumping the fuel vapor trapped in the canister 11 into the intake system 7 of the engine 6.

The intake system 7 may include an intake pipe 7*a*, and the intake pipe 7*a* may be provided with a charger 8. The charger 8 may compress the ambient air introduced through an air inlet 7*c* of the intake pipe 7*a*. The charger 8 may be one of a supercharger and a turbocharger. FIG. 1 illustrates the turbocharger by way of example. The turbocharger 8 may include a compressor 8*a* mounted on the intake pipe 7*a* of the engine 6, and a turbine 8*b* mounted on an exhaust pipe 9 of the engine 6. The compressor 8*a* may be connected to the turbine 8*b* through a common shaft 8*c*.

The intake pipe 7*a* may be provided with an intercooler 4 and a throttle valve 3. The intercooler 4 may be disposed on the downstream side of the compressor 8*a* of the charger 8, and the throttle valve 3 may be disposed on the downstream side of the intercooler 4.

The exhaust pipe 9 may be provided with an oxygen sensor 9*c*. The oxygen sensor 9*c* may detect the concentration of oxygen contained in exhaust gases to measure an air-fuel (A/F) ratio.

The fuel tank 5 may store a fuel, and as the fuel vaporizes in the fuel tank 5, a fuel vapor may be generated.

The canister 11 may be connected to the fuel tank 5 through a first conduit 21. The fuel vapor generated in the fuel tank 5 may be delivered to the canister 11 through the first conduit 21, and be trapped in the canister 11. For example, the canister 11 may have activated-carbon.

The canister 11 may have an inlet port 11*a* through which the fuel vapor is introduced, and an outlet port 11*b* through which the fuel vapor is discharged. The inlet port 11*a* may communicate with the first conduit 21 so that the fuel vapor in the fuel tank 5 may flow into the canister 11 through the inlet port 11*a* and be trapped in the canister 11. The outlet port 11*b* may communicate with a second conduit 22 so that the fuel vapor trapped in the canister 11 may be discharged through the outlet port 11*b*, allowing the purging of the fuel vapor from the canister 11.

The canister 11 may have a vent port 11*c*, and the vent port 11*c* may communicate with a third conduit 23. An air inlet 31 may be provided at an end of the third conduit 23. The air inlet 31 may include an air filter. The third conduit 23 may be provided with a canister close valve 32 selectively opening and closing the vent port 11*c*. For example, the canister close valve 32 may be opened in a normal state, and be closed when a leak is diagnosed.

The purge pump 15 may be connected to the canister 11 through the second conduit 22, and the purge pump 15 may be disposed on the downstream side of the canister 11 in a direction in which the fuel vapor is purged.

The purge pump 15 may have an inlet port 15*a* and an outlet port 15*b*. The inlet port 15*a* of the purge pump 15 may communicate with the second conduit 22, and the inlet port 15*a* of the purge pump 15 may be connected to the canister 11 through the second conduit 22. The outlet port 15*b* of the purge pump 15 may communicate with a fourth conduit 24, and the outlet port 15*b* of the purge pump 15 may be connected to the purge control valve 13 through the fourth conduit 24. Thus, the purge pump 15 may be connected to the purge control valve 13 through the fourth conduit 24, and the purge pump 15 may be disposed between the purge control valve 13 and the intake pipe 7*a*.

By driving the purge pump 15, a negative pressure may be generated at the outlet of the canister 11 (the second conduit 22 communicating with the outlet port 11*b* of the canister 11). As the purge control valve 13 is driven in accordance with a duty cycle, a purge flow rate of the fuel vapor into the intake system 7 of the engine 6 may be precisely controlled.

The purge control valve 13 may communicate with the intake system 7. According to an exemplary form, the purge control valve 13 may be a solenoid valve, so that the purge control valve 13 may be driven in accordance with a predetermined duty cycle.

The purge control valve 13 may have an inlet port 13*a* and an outlet port 13*b*. The inlet port 13*a* of the purge control valve 13 may communicate with the fourth conduit 24, and the purge control valve 13 may be connected to the purge pump 15 through the fourth conduit 24. The outlet port 13*b* of the purge control valve 13 may communicate with a fifth conduit 25, and the purge control valve 13 may be connected to the intake pipe 7*a* of the intake system 7 through the fifth conduit 25.

The fifth conduit 25 may be connected to the upstream side of the charger 8 on the intake pipe 7*a*, so that the fuel vapor may be purged from the canister 11 to the upstream side of the charger 8. As the fuel vapor is purged into the upstream side of the charger 8, the fuel vapor along with the ambient air may be compressed by the charger 8, and thus the combustion efficiency and fuel efficiency of the engine 6 may be significantly improved.

Referring to FIG. 1, the active canister purge system 10 may include a first pressure sensor 12 detecting a pressure at the inlet of the purge control valve 13, and a second pressure sensor 18 detecting a pressure at the inlet of the purge pump 15.

The first pressure sensor 12 may be disposed between the inlet port 13*a* of the purge control valve 13 and the outlet port 15*b* of the purge pump 15. In other words, the first pressure sensor 12 may be mounted on the fourth conduit 24, so that the first pressure sensor 12 may detect a pressure at the inlet of the purge control valve 13 and a pressure at the outlet of the purge pump 15.

The second pressure sensor 18 may be disposed between the inlet port 15*a* of the purge pump 15 and the outlet port 11*b* of the canister 11. The second pressure sensor 18 may be mounted on the second conduit 22, so that the second pressure sensor 18 may detect a pressure at the inlet of the purge pump 15 and a pressure at the outlet of the canister 11. The second pressure sensor 18 may be a temperature sensor integrated type pressure sensor. Thus, the second pressure sensor 18 may detect the pressure and temperature at the inlet of the purge pump 15.

The intake pipe 7*a* may have a third pressure sensor 19 disposed on the upstream side of the charger 8, and the third pressure sensor 19 may detect a pressure of the intake pipe 7*a*, especially, a pressure at the upstream side of the charger 8.

The active canister purge system 10, according to an exemplary form of the present disclosure, may include a controller 40. The controller 40 may control and manage the overall operations of the engine. The controller 40 may be an engine control unit, an engine control module, or the like.

The controller 40 may receive information from a variety of sensors, and transmit control signals to actuators. The controller 40 may include a processor 41 and a memory 42. The processor 41 may receive instructions and data stored in the memory 42, and transmit instructions to the actuators. Here, the sensors include the first pressure sensor 12, the second pressure sensor 18, the third pressure sensor 19, the oxygen sensor 9*c* mounted on the exhaust pipe 9 of the engine 6, and the like, and the actuators include a fuel injector (not shown), the throttle valve 3, an EGR valve (not shown), the purge control valve 13, the purge pump 15, and the like. The memory 42 may be a data store such as a hard disk drive, a solid state drive, a server, a volatile storage medium, or a non-volatile storage medium.

The controller 40 may be a stand-alone device or may be embedded in a vehicle controller such as an engine control unit or an engine control module.

The purge control valve 13, the first pressure sensor 12, the second pressure sensor 18, the third pressure sensor 19, the purge pump 15, and the oxygen sensor 9*c* mounted on the exhaust system 9 of the engine 6 may be electrically connected to the controller 40.

The controller 40 may detect whether or not the purge control valve 13 is stuck, thereby accurately diagnosing whether or not the fuel vapor leaks. The "stuck" state of the purge control valve 13 refers to a state in which a valve member of the purge control valve 13 is stuck to a specific position of a valve housing of the purge control valve 13 due to various causes.

According to an exemplary form, the controller 40 may diagnose whether or not the purge control valve 13 is stuck open in a non-purging condition. Here, the non-purging condition refers to a condition in which the purge pump 15 does not operate and the purge control valve 13 is closed, and thus the fuel vapor trapped in the canister 11 is not purged from the canister 11 into the intake system 7. The open stuck state refers to a state in which the purge control valve 13 is stuck open due to valve failure when the purge control valve 13 is to be closed under the non-purging condition.

Meanwhile, the open stuck state of the purge control valve 13 may be divided into a full open stuck state and a middle open stuck state depending on the degree of opening of the purge control valve 13. The full open stuck state refers to a state in which the purge control valve 13 is fully stuck open, and the middle open stuck state refers to a state in which the purge control valve 13 is partially stuck open or is stuck in a partially open position.

The controller 40 may detect whether or not the pressure at the inlet of the purge control valve 13 is varied to correspond to the pressure variation in the intake pipe 7*a* under the non-purging condition, thereby diagnosing the open stuck state of the purge control valve 13.

Figure 2:
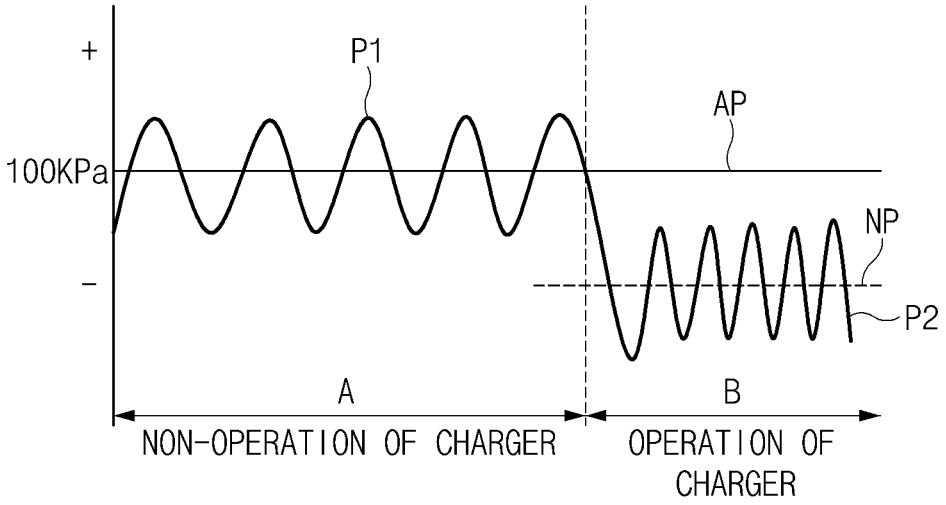
FIG. 2 illustrates variations in pressure of an intake pipe in accordance with a combustion process of an engine.

FIG. 2 illustrates variations in pressure of the intake pipe in accordance with the combustion process of the engine. As illustrated in FIG. 2, the pressure of the intake pipe 7*a* disposed on the upstream side of the compressor 8*a* of the charger 8 may vary according to the combustion process of the engine and the operation or non-operation of the charger 8.

In a non-operating period of the charger 8 (see period "A" in FIG. 2), the flow rate of the air introduced into the intake pipe 7*a* may be relatively low so that the pressure of the intake pipe 7*a* may vary regularly or irregularly around the atmospheric pressure AP (for example, 100 KPa) in accordance with a pressure variation curve P1 in period "A".

In an operating period of the charger 8 (see period "B" in FIG. 2), the flow rate of the air passing through the intake pipe 7*a* may be relatively high so that a negative pressure NP (for example, −4 KPa) lower than the atmospheric pressure may be generated at the intake pipe 7*a* disposed on the upstream side of the compressor 8*a* of the charger 8, and thus the pressure of the intake pipe 7*a* may vary regularly or irregularly around the negative pressure NP in accordance with a pressure variation curve P2 in period "B".

Figure 3:
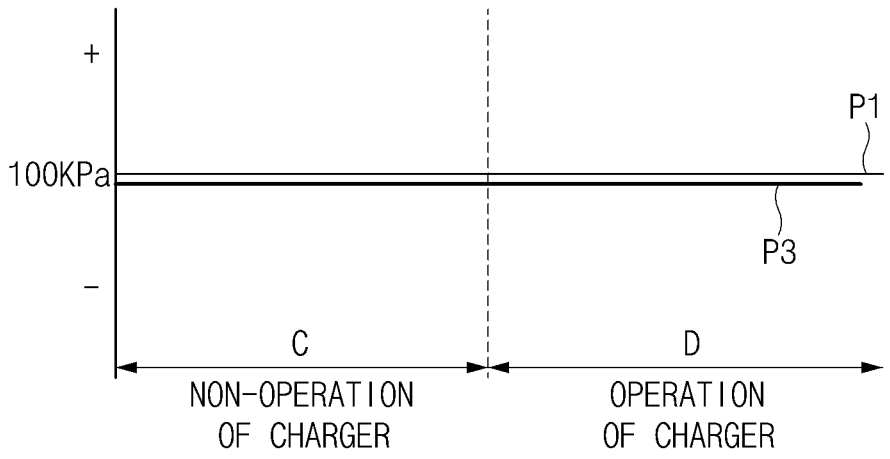
FIG. 3 illustrates variations in pressure at an inlet of a purge control valve when the purge control valve operates normally in a non-purging condition.

FIG. 3 illustrates variations in pressure at the inlet of the purge control valve 13 when the purge control valve 13 operates normally in the non-purging condition.

When the purge control valve 13 operates normally in the non-purging condition, the purge control valve 13 may not be stuck open so that the purge control valve 13 may be kept closed. Thus, the pressure at the inlet of the purge control valve 13 may be kept constant around the atmospheric pressure (for example, 100 KPa) in accordance with P3 in FIG. 3, regardless of a non-operating period of the charger 8 (see period "C" in FIG. 3) and an operating period of the charger 8 (see period "D" in FIG. 3).

Figure 4:
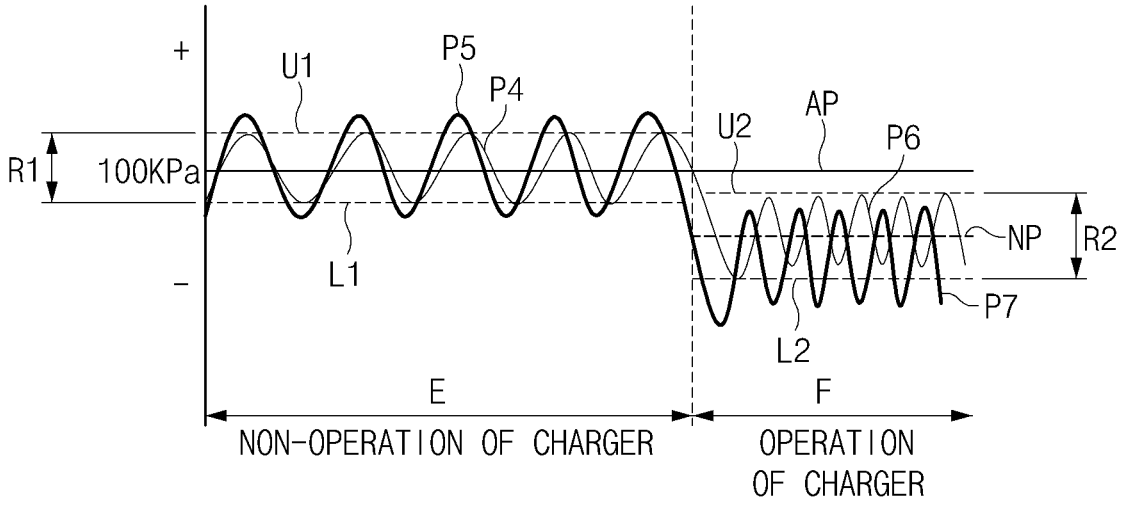
FIG. 4 illustrates variations in pressure at an inlet of a purge control valve when the purge control valve operates abnormally in a non-purging condition.

FIG. 4 illustrates variations in pressure at the inlet of the purge control valve 13 when the purge control valve 13 operates abnormally in the non-purging condition.

When the purge control valve 13 is in the open stuck state in the non-purging condition, the purge control valve 13 may be stuck open so that the fourth conduit 24 may communicate with the intake pipe 7*a* through the purge control valve 13 and the fifth conduit 25. Thus, the pressure at the inlet of the purge control valve 13 may vary as illustrated in FIG. 4, similar to the pressure variation in the intake pipe 7*a*.

The controller 40 may set a first pressure range R1 and a second pressure range R2 in accordance with the operation or non-operation of the charger 8.

According to an exemplary form, when the charger 8 does not operate, the controller 40 may set the first pressure range R1. Here, the first pressure range R1 may be defined by a first upper limit threshold U1 and a first lower limit threshold L1. When the charger 8 operates, a negative pressure may be generated at the intake pipe 7*a* and the inlet of the purge control valve 13, and the controller 40 may set the second pressure range R2 less than the first pressure range R1. Here, the second pressure range R2 may be defined by a second upper limit threshold U2 and a second lower limit threshold L2.

In a non-operating period of the charger 8 (see period "E" in FIG. 4), the pressure at the inlet of the purge control valve 13 may vary regularly or irregularly around the atmospheric pressure AP, which corresponds to the pressure variation in the intake pipe 7*a* (see period "A" in FIG. 2).

In the non-operating period of the charger 8 (see period "E" in FIG. 4), when the purge control valve 13 is in the middle open stuck state, the pressure of the purge control valve 13 may vary regularly or irregularly around the atmospheric pressure AP in accordance with a pressure variation curve P4 in period "E", and the pressure variation curve P4 in period "E" may be within the first pressure range R1.

In the non-operating period of the charger 8 (see period "E" in FIG. 4), when the purge control valve 13 is in the full open stuck state, the pressure of the purge control valve 13 may vary regularly or irregularly around the atmospheric pressure AP in accordance with a pressure variation curve P5 in period "E", and at least some pressure values of the pressure variation curve P5 in period "E" may deviate beyond the predetermined first pressure range R1. For example, at least some pressure values of the purge control valve 13 may exceed the first upper limit threshold U1 or be less than the first lower limit threshold L1.

By determining whether or not at least some pressure values of the purge control valve 13 deviate beyond the predetermined first pressure range R1 in the non-operating period of the charger 8 (see period "E" in FIG. 4), the controller 40 may diagnose the middle open stuck or full open stuck state of the purge control valve 13 during the operation of the charger 8.

In an operating period of the charger 8 (see period "F" in FIG. 4), a negative pressure NP may be generated at the inlet of the purge control valve 13, which corresponds to the negative pressure of the intake pipe 7*a*, and the pressure at the inlet of the purge control valve 13 may vary regularly or irregularly around the negative pressure NP, which corresponds to the pressure variation in the intake pipe 7*a* (see period "A" in FIG. 2).

In the operating period of the charger 8 (see period "F" in FIG. 4), when the purge control valve 13 is in the middle open stuck state, the pressure of the purge control valve 13 may vary regularly or irregularly around the atmospheric pressure AP in accordance with a pressure variation curve P6 in period "F", and the pressure variation curve P6 in period "F" may be within the predetermined second pressure range R2.

In the operating period of the charger 8 (see period "F" in FIG. 4), when the purge control valve 13 is in the full open stuck state, the pressure of the purge control valve 13 may vary regularly or irregularly around the negative pressure NP in accordance with a pressure variation curve P7 in period "F", and at least some pressure values of the pressure variation curve P7 in period "F" may deviate beyond the predetermined second pressure range R2. For example, at least some pressure values of the purge control valve 13 may be less than the second lower limit threshold L2.

By determining whether or not at least some of the pressure values at the inlet of the purge control valve 13 exceed the second upper limit threshold U2 or are less than the second lower limit threshold L2, the controller 40 may diagnose the middle open stuck or full open stuck state of the purge control valve 13 during the operation of the charger 8.

Figure 5:
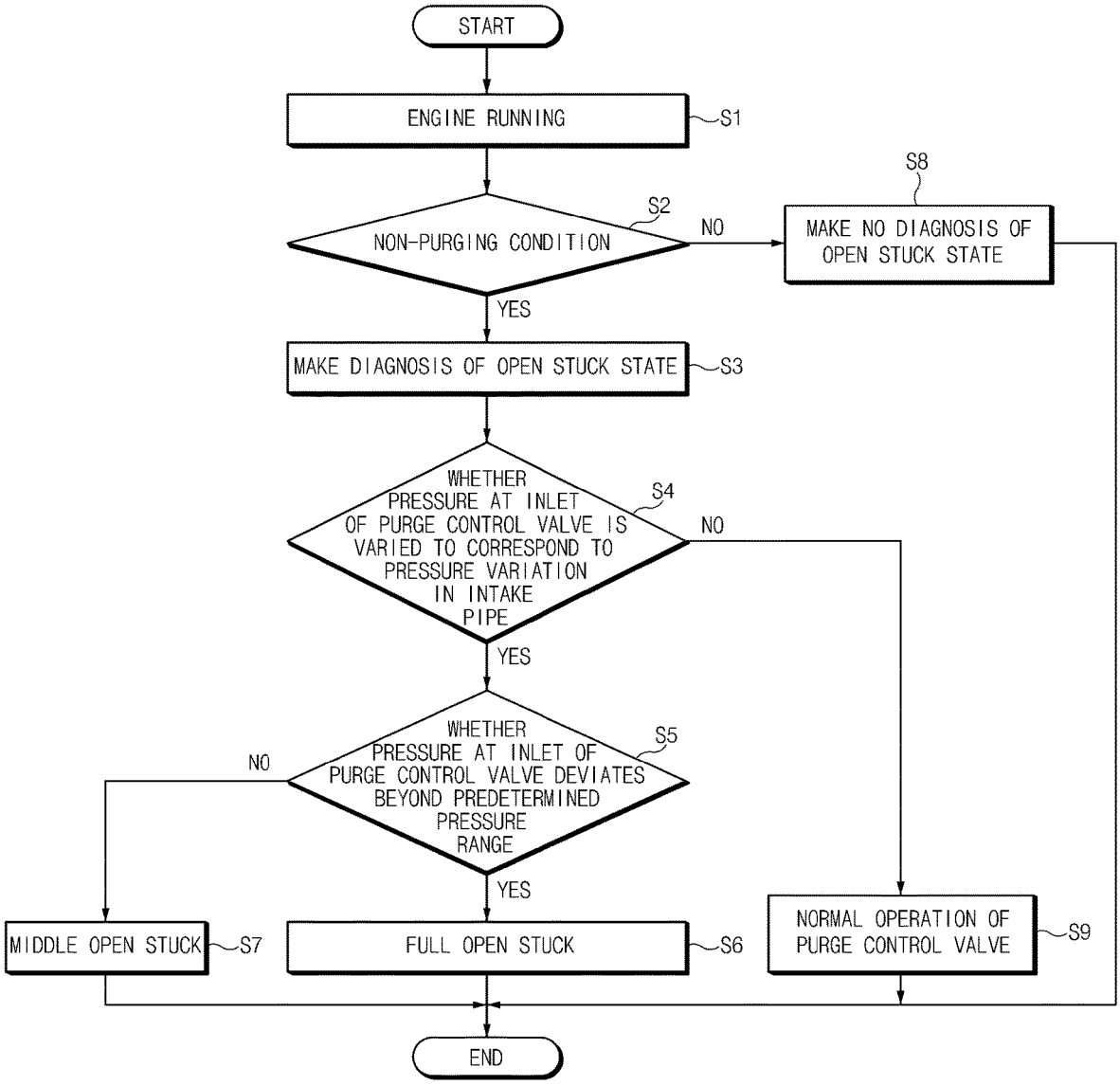
FIG. 5 illustrates a flowchart of a diagnostic method of an active canister purge system according to an exemplary form of the present disclosure.

FIG. 5 illustrates a flowchart of a diagnostic method of an active canister purge system, according to an exemplary form of the present disclosure.

Referring to FIG. 5, when the engine 6 of the vehicle is running (S1), the controller 40 may determine whether or not a non-purging condition is satisfied (S2). The non-purging condition refers to a condition in which the purge pump 15 does not operate and the purge control valve 13 is closed so that there is no purging of a fuel vapor trapped in the canister 11. The controller 40 may determine whether or not the non-purging condition is satisfied on the basis of engine control information such as the amount (concentration) of the fuel vapor trapped in the canister 11, coolant temperature information received from a variety of sensors, and an air-fuel ratio.

When the non-purging condition is satisfied, the controller 40 may make a diagnosis of the open stuck state of the purge control valve 13 (S3). When the non-purging condition is not satisfied, the controller 40 may not make a diagnosis of the open stuck state of the purge control valve 13 (S8).

The controller 40 may determine whether or not a pressure at the inlet of the purge control valve 13 is varied to correspond to a pressure variation in the intake pipe 7*a* (see P1 and P2 in FIG. 2) (S4).

According to an exemplary form, the pressure of the intake pipe 7*a* (that is, the pressure at the upstream side of the charger 8) may be measured by the third pressure sensor 19 mounted on the intake pipe 7*a*, and the pressure at the inlet of the purge control valve 13 may be measured by the first pressure sensor 12. The measured pressure of the intake pipe 7*a* and the measured pressure at the inlet of the purge control valve 13 may be compared to determine whether or not the pressure at the inlet of the purge control valve 13 is varied to correspond to the pressure variation at the upstream side of the charger 8 (see P4, P5, P6, and P7 in FIG. 4).

In the non-operating period of the charger 8 (see period "E" in FIG. 4), the pressure at the inlet of the purge control valve 13 may vary regularly or irregularly around the atmospheric pressure AP, which corresponds to the pressure variation in the intake pipe 7*a* (see period "A" in FIG. 2). In the operating period of the charger 8 (see period "F" in FIG. 4), the negative pressure NP may be generated at the inlet of the purge control valve 13, which corresponds to the negative pressure of the intake pipe 7*a*, and the pressure at the inlet of the purge control valve 13 may vary regularly or irregularly around the negative pressure NP, which corresponds to the pressure variation in the intake pipe 7*a* (see period "B" in FIG. 2).

When the pressure at the inlet of the purge control valve 13 is varied to correspond to the pressure variation in the intake pipe 7*a*, the controller 40 may determine whether or not the pressure at the inlet of the purge control valve 13 deviates beyond a predetermined pressure range (S5). When the pressure at the inlet of the purge control valve 13 is not varied to correspond to the pressure variation in the intake pipe 7*a*, the controller 40 may diagnose that the purge control valve 13 operates normally (S9).

When the pressure at the inlet of the purge control valve 13 deviates beyond the predetermined pressure range, the full open stuck state of the purge control valve 13 may be diagnosed (S6). Here, the controller 40 may set the first pressure range R1 and the second pressure range R2 depending on the operation or non-operation of the charger 8. According to an exemplary form, when the charger 8 does not operate, the controller 40 may set the first pressure range R1, and the first pressure range R1 may be defined by the first upper limit threshold U1 and the first lower limit threshold L1. When the charger 8 operates, the negative pressure may be generated at the intake pipe 7*a* and the inlet of the purge control valve 13 so that the controller 40 may set the second pressure range R2 less than the first pressure range R1, and the second pressure range R2 may be defined by the second upper limit threshold U2 and the second lower limit threshold L2.

In the non-operating period of the charger 8 (see period "E" in FIG. 4), when the purge control valve 13 is in the full open stuck state, the pressure of the purge control valve 13 may vary regularly or irregularly around the atmospheric pressure AP in accordance with the pressure variation curve P5 in period "E", and at least some pressure values of the pressure variation curve P5 in period "E" may deviate beyond the predetermined first pressure range R1. For example, at least some pressure values of the purge control valve 13 may exceed the first upper limit threshold U1 or be less than the first lower limit threshold L1. In the operating period of the charger 8 (see period "F" in FIG. 4), when the purge control valve 13 is in the full open stuck state, the pressure of the purge control valve 13 may vary regularly or irregularly around the negative pressure NP in accordance with the pressure variation curve P7 in period "F", and at least some pressure values of the pressure variation curve P7 in period "F" may deviate beyond the predetermined second pressure range R2. For example, at least some pressure values of the purge control valve 13 may be less than the second lower limit threshold L2.

When the pressure at the inlet of the purge control valve 13 is within the predetermined pressure range, the middle open stuck state of the purge control valve 13 may be diagnosed (S7). In the non-operating period of the charger 8 (see period "E" in FIG. 4), when the purge control valve 13 is in the middle open stuck state, the pressure of the purge control valve 13 may vary regularly or irregularly around the atmospheric pressure AP in accordance with the pressure variation curve P4 in period "E", and the pressure variation curve P4 in period "E" may be within the predetermined first pressure range R1. In the operating period of the charger 8 (see period "F" in FIG. 4), when the purge control valve 13 is in the middle open stuck state, the pressure of the purge control valve 13 may vary regularly or irregularly around the atmospheric pressure AP in accordance with the pressure variation curve P6 in period "F", and the pressure variation curve P6 in period "F" may be within the predetermined second pressure range R2.

As set forth above, the active canister purge system and the diagnostic method thereof, according to exemplary forms of the present disclosure, may provide an accurate diagnosis of the open stuck state of the purge control valve, thereby eliminating the instability of engine combustion, allowing the vehicle to quickly go into limp-home mode, and accurately determining whether or not the fuel vapor leaks.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

What is claimed is:

1. An active canister purge system, comprising:

a canister trapping a fuel vapor generated in a fuel tank;

a purge control valve configured to purge the trapped fuel vapor from the canister into an intake pipe;

a purge pump configured to pump the fuel vapor trapped in the canister into the intake pipe;

a pressure sensor configured to detect a pressure at an inlet of the purge control valve; and a controller configured to determine an open stuck state of the purge control valve based on a change to the detected pressure at the inlet of the purge control valve while a pressure in the intake pipe in a non-purging condition varies, wherein the controller diagnoses that the purge control valve is in a middle open stuck state when the detected pressure at the inlet of the purge control valve is within a predetermined pressure range.

2. The active canister purge system according to claim 1, wherein the controller diagnoses that the purge control valve is in a full open stuck state when the detected pressure at the inlet of the purge control valve deviates beyond the predetermined pressure range.

3. The active canister purge system according to claim 1, wherein the controller sets different pressure ranges based on whether a charger mounted on the intake pipe operates.

4. The active canister purge system according to claim 3, wherein the controller sets a first pressure range when the charger does not operate, and the first pressure range is defined by a first upper limit threshold and a first lower limit threshold.

5. The active canister purge system according to claim 4, wherein the controller diagnoses that the purge control valve is in a full open stuck state when the detected pressure at the inlet of the purge control valve deviates beyond the first pressure range, and the controller diagnoses that the purge control valve is in the middle open stuck state when the detected pressure at the inlet of the purge control valve is within the first pressure range.

6. The active canister purge system according to claim 3, wherein the controller sets a second pressure range when the charger operates, and the second pressure range is defined by a second upper limit threshold and a second lower limit threshold.

7. The active canister purge system according to claim 6, wherein the controller diagnoses that the purge control valve is in a full open stuck state when the detected pressure at the inlet of the purge control valve deviates beyond the second pressure range, and the controller diagnoses that the purge control valve is in the middle open stuck state when the detected pressure at the inlet of the purge control valve is within the second pressure range.

8. A diagnostic method of an active canister purge system, the diagnostic method comprising:

determining whether a non-purging condition is satisfied, the non-purging condition being a condition in which a purge pump does not operate and a purge control valve is closed;

determining, when the non-purging condition is determined, whether a pressure detected at an inlet of the purge control valve is varied in response to a pressure variation in an intake pipe; and diagnosing an open stuck state of the purge control valve when the pressure detected at the inlet of the purge control valve is varied in response to the pressure variation in the intake pipe, wherein the diagnosing the open stuck state comprises:

diagnosing that the purge control valve is in a full open stuck state when the pressure at the inlet of the purge control valve deviates beyond a predetermined pressure range; and diagnosing that the purge control valve is in a middle open stuck state when the pressure at the inlet of the purge control valve is within the predetermined pressure range.

9. The diagnostic method according to claim 8, wherein different pressure ranges are set based on whether a charger mounted on the intake pipe operates.

10. The diagnostic method according to claim 9, wherein a first pressure range is set when the charger does not operate, and the first pressure range is defined by a first upper limit threshold and a first lower limit threshold.

11. The diagnostic method according to claim 10, wherein the diagnosing the open stuck state comprises:

diagnosing that the purge control valve is in the full open stuck state when the pressure at the inlet of the purge control valve deviates beyond the first pressure range; and diagnosing that the purge control valve is in the middle open stuck state when the pressure at the inlet of the purge control valve is within the first pressure range.

12. The diagnostic method according to claim 9, wherein a second pressure range is set when the charger operates, and the second pressure range is defined by a second upper limit threshold and a second lower limit threshold.

13. The diagnostic method according to claim 12, wherein the diagnosing the open stuck state comprises:

diagnosing that the purge control valve is in the full open stuck state when the pressure at the inlet of the purge control valve deviates beyond the second pressure range; and diagnosing that the purge control valve is in the middle open stuck state when the pressure at the inlet of the purge control valve is within the second pressure range.

* * * * *